US009000682B2

(12) United States Patent
Ruan et al.

(10) Patent No.: US 9,000,682 B2
(45) Date of Patent: Apr. 7, 2015

(54) DIMMING CIRCUIT AND METHOD FOR LEDS

(71) Applicant: Richpower Microelectronics Corporation, Grand Cayman, British West Indies (KY)

(72) Inventors: Chen-Jie Ruan, Shanghai (CN); Chin-Hui Wang, New Taipei (TW); Peng-Ju Lan, New Taipei (CN)

(73) Assignee: Richpower Microelectronics Corporation, Grand Cayman (KY)

( * ) Notice: Subject to any disclaimer, the term of this patent is extended or adjusted under 35 U.S.C. 154(b) by 21 days.

(21) Appl. No.: 13/827,279

(22) Filed: Mar. 14, 2013

(65) Prior Publication Data

US 2013/0200822 A1 Aug. 8, 2013

Related U.S. Application Data

(62) Division of application No. 13/081,131, filed on Apr. 6, 2011, now Pat. No. 8,581,514.

(30) Foreign Application Priority Data

Apr. 14, 2010 (CN) ..... 2010 1 0146432

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 37/02* (2013.01); *H05B 33/0809* (2013.01); *H05B 33/0815* (2013.01)

(58) Field of Classification Search

None

See application file for complete search history.

(56) References Cited

U.S. PATENT DOCUMENTS

| | | | | |
|---|---|---|---|---|
| 8,581,514 | B2 * | 11/2013 | Ruan et al. | 315/297 |
| 2008/0238387 | A1 * | 10/2008 | Schmeller et al. | 323/282 |
| 2009/0237007 | A1 * | 9/2009 | Leng | 315/297 |

* cited by examiner

*Primary Examiner* — Anh Tran

(74) *Attorney, Agent, or Firm* — Muncy, Geissler, Olds & Lowe, P.C.

(57) ABSTRACT

A dimming circuit and method for a LED provide a first driving voltage or a second driving voltage according to a dimming signal provided by a functional IC to enable or disable the LED. The values of the first and second driving voltages are controlled so that overstressing of the LED is avoided while the functional IC is capable of working even when the LED is off. The LED's life time is thus prolonged.

3 Claims, 6 Drawing Sheets

DIMMING CIRCUIT AND METHOD FOR LEDS

CROSS REFERENCE TO RELATED APPLICATIONS

This application is a Divisional of co-pending application Ser. No. 13/081,131, filed on Apr. 6, 2011, for which priority is claimed under 35 U.S.C. §120; and this application claims priority of Application No. 201010146432.5 filed in P.R. China on Apr. 14, 2010 under 35 U.S.C. §119, the entire contents of all of which are hereby incorporated by reference.

FIELD OF THE INVENTION

The present invention is related generally to a dimming circuit and method and, more particularly, to a dimming circuit and method for LEDs.

BACKGROUND OF THE INVENTION

In LED dimming systems, conventionally the LED is turned on and off between ground and its forward voltage to fulfill dimming function. The abrupt change of voltage may arise of the danger of overstressing the LED and other peripheral components. For a system whose power is LED's output, it will temporarily shutdown during the LED's off period. This causes limits when designing such circuits. In further detail, as shown in FIG. 1, a conventional LED dimming circuit includes a boost integrated circuit (IC) 10 to boost a battery voltage Vbat into a driving voltage Vo for a LED and a functional IC 12 connected to the anode of the LED for dimming control. Dimming is realized through a switch M serially connected to the LED, for which the functional IC 12 provides a dimming signal Dpwm to switch the switch M in order to adjust the average current Iled of the LED, thereby achieving dimming control for such as bright, dim and flashing. Circuits and operations for the boost IC 10 and the functional IC 12 have been mature and need not to be discussed in detail herein. When the functional IC 12 turns off the switch M to cut off the current Iled, since no path to ground exists, the output VOUT of the boost IC 10 will endure a very high voltage due to the continuously charged capacitor Cout connected at the output VOUT, and thereby push the boost IC 10 into its over voltage protection mode. When the functional IC 12 turns on the switch M again, the charge stored in the capacitor Cout will rush into the LED, and the LED will endure a large voltage before the output voltage Vo drops to the LED's normal forward voltage again. In this way, although the functional IC 12 can work when the LED is off, the boost IC 10, the functional IC 12 and the LED are overstressed by a very high voltage and this causes quality concerns. For those functional ICs sensitive to power, this method may even cause errors during dimming period.

FIG. 2 shows another possible solution for a battery powered LED flashlight dimming system, in which the functional IC 12 is powered separately, e.g. by another battery Vbat2. When the LED is on, the functional IC 12 enables the boost IC 10 to boost the battery voltage Vbat1 into a driving voltage Vo equal to the normal forward voltage of the LED. When the LED is off, the functional IC 12 disables the boost IC 10, and thus the driving voltage Vo will not increase to the extent that the boost IC 12 enters its over voltage protection mode. By doing this, not entering the over voltage protection mode makes the whole system safer and prolongs the utility time of the LED. However, this approach also has two drawbacks. (1) For low battery power, e.g. 0.9V, most functional ICs are unable to work under such low supply voltage. This limits the application of the solution. (2) The LED is dimmed between the normal forward voltage Vf and a 'low' voltage (i.e. Vbat1−VD). The voltage drop during dimming is not minimized and the LED is still overstressed by some unnecessary abrupt voltage change. For example, assuming that Vbat1=1.5V, VD=0.7V and Vf=3.6V, the LED will be overstressed by an abrupt voltage change $\Delta V = Vf - (Vbat1 - VD) = 3.6V - (1.5V - 0.7V) - 2.8V$ when it is switched from on to off, or from off to on. This abrupt voltage change ΔV increases with the decrease of the battery voltage Vbat1. The abrupt voltage change will shorten the LED's life time.

Therefore, it is desired a dimming circuit and method for LEDs that prolongs the LED's life time while maintains a certain low voltage when the LED is off to support other functional circuits.

SUMMARY OF THE INVENTION

An objective of the present invention is to provide a dimming circuit and method for LEDs.

Another objective of the present invention is to provide a dimming circuit and method that prevent LEDs from large abrupt voltage change when being dimming.

According to the present invention, a dimming circuit and method for a LED select a first driving voltage setting signal or a second driving voltage setting signal according to a dimming signal provided by a functional IC, to determine the output voltage supplied to the LED being a first driving voltage or a second driving voltage. The output voltage is also supplied to the functional IC, and each of the first driving voltage and the second driving voltage is as large as enough to drive the functional IC.

By controlling the values of a first driving voltage and a second driving voltage to turn on and off a LED, overstressing of the LED is avoided while the functional IC is capable of working even when the LED is off. The LED's life time is thus prolonged.

BRIEF DESCRIPTION OF THE DRAWINGS

These and other objectives, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

According to the present invention, the dimming circuit and method are directed to control the driving voltages of enabling and disabling a LED, so as to prevent the LED switched between dark and light from large abrupt voltage change, for example, from ground to the LED's forward voltage. The term "disable" refers to a state where a LED is not bright in human eyes. Taking a LED having a forward voltage of 3.6V and power of 3 W for example, when the applied voltage is 2.5V, the current Iled of the LED is completely cut off, so 2.5V can be set as the driving voltage of disabling the LED, and 3.6V is the driving voltage of enabling the LED. In addition, the driving voltage supplied to the LED can be also supplied to a functional IC and other circuits. Since the driving voltage still has a value as high as 2.5V when the LED is disabled, the functional IC and other circuits can normally work even when the LED is dark.

Figure 1:
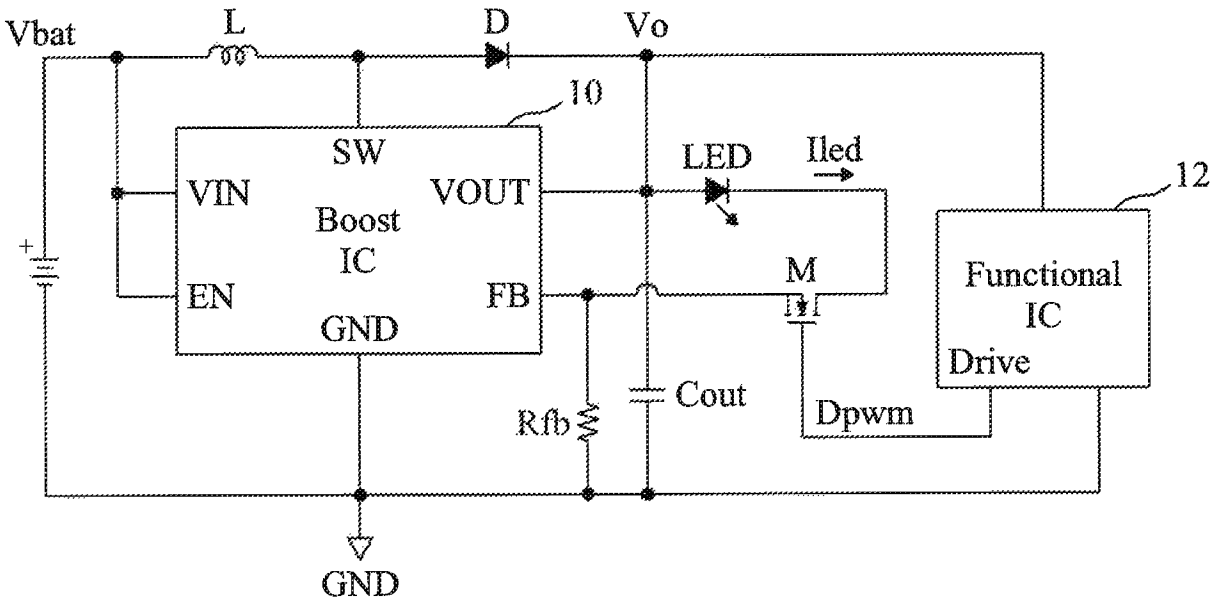
Fig. 1 Prior Art
FIG. 1 is a circuit diagram of a conventional battery powered LED flashlight dimming system.
Figure 2:
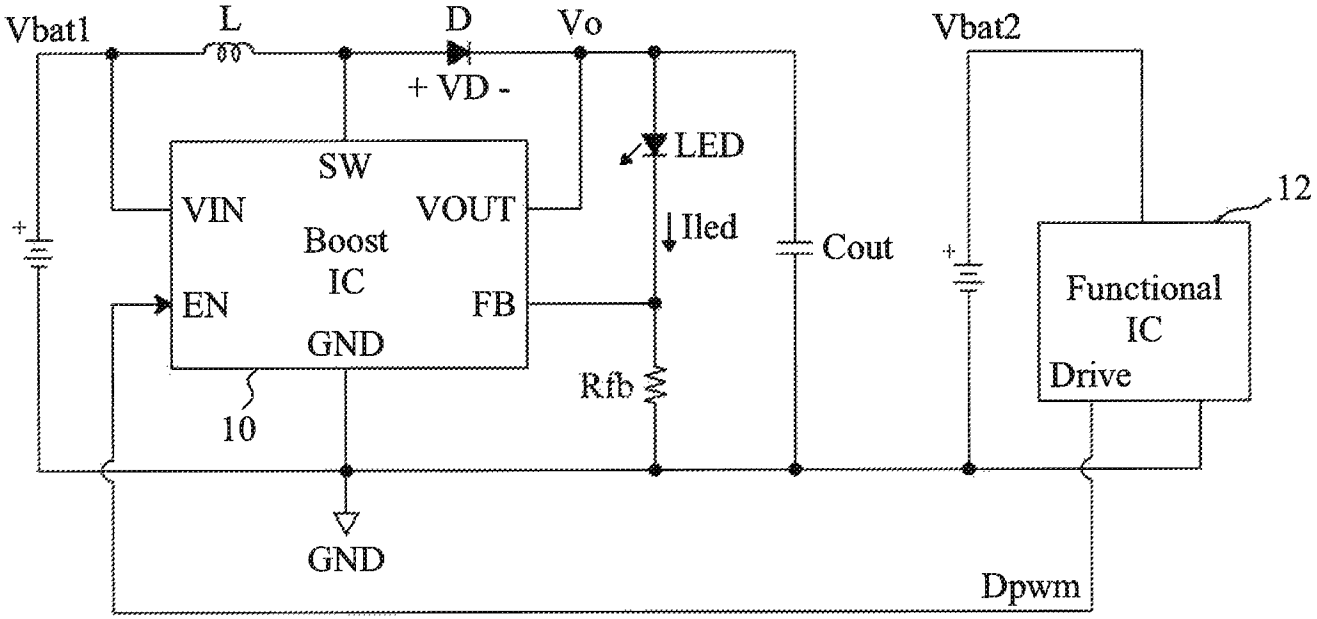
Fig. 2 Prior Art
FIG. 2 is a circuit diagram of another conventional battery powered LED flashlight dimming system.
Figure 3:
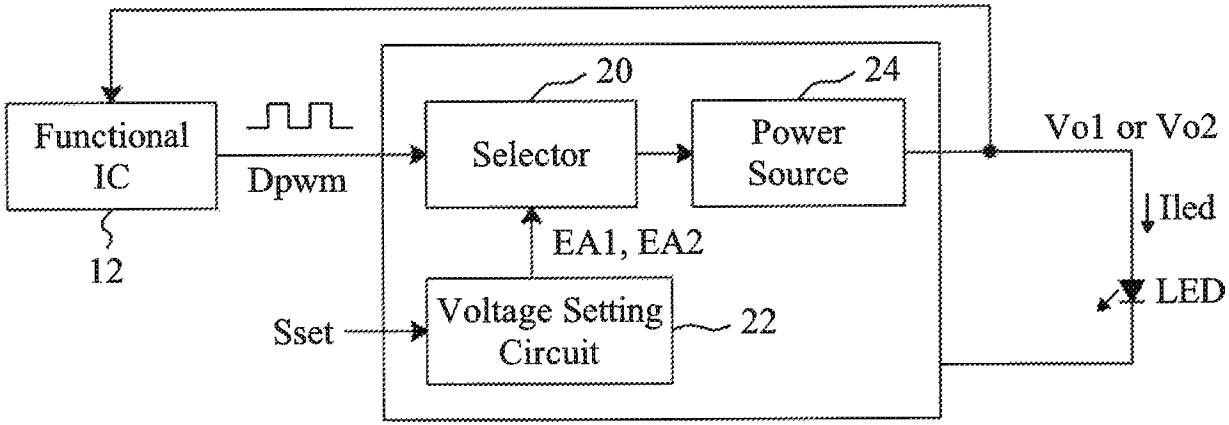
FIG. 3 is a first embodiment according to the present invention.

As shown in FIG. 3, a LED dimming system according to the present invention includes a functional IC 12 to provide a dimming signal Dpwm, a voltage setting circuit 22 to provide two driving voltage setting signals EA1 and EA2, a selector 20 to select one of the driving voltage setting signals EA1 and EA2 according to the dimming signal Dpwm for a power source 24 to determine its output voltage for the LED and the functional IC 12 is the driving voltage Vo1 or Vo2. Each of the driving voltages Vo1 and Vo2 is as large as enough to drive the functional IC 12. When the dimming signal Dpwm is high, the selector 20 sends out the driving voltage setting signal EA1, and the output voltage of the power source 24 is the driving voltage Vo1 which enables the LED. When the dimming signal Dpwm is low, the selector 20 sends out the driving voltage setting signal EA2, and the output voltage of the power source 24 is the driving voltage Vo2 which disables the LED. The driving voltage Vo2 may be set by an off voltage setting signal Sset provided to the voltage setting circuit 22, and thus the disable voltage Vo2 of the LED is preset externally or in the system. Instead of abrupt voltage change between ground and the LED's forward voltage, the LED is turned on and off between a certain pre-programmed low voltage and its forward voltage. For example, for a Vf=3.6V, P–3 W LED, its current Iled is totally off when 2.5V is applied thereto. Thus the LED can be dimmed through Vo2=2.5V as an off voltage and Vo1=3.6V as an on voltage, with a voltage change ΔV=Vo1–Vo2=3.6V–2.5V=1.1V. In this manner, overstressing of the LED is avoided and other circuits whose power is the LED's output is able to work even during the LED's off period when dimming the LED. The power source 24 may be any circuit which can supply power to illuminate the LED, for example a buck, boost, linear driver etc. Moreover, the power source 24 is not necessarily connected to the anode of the LED, and may be connected to the cathode of the LED.

Figure 4:
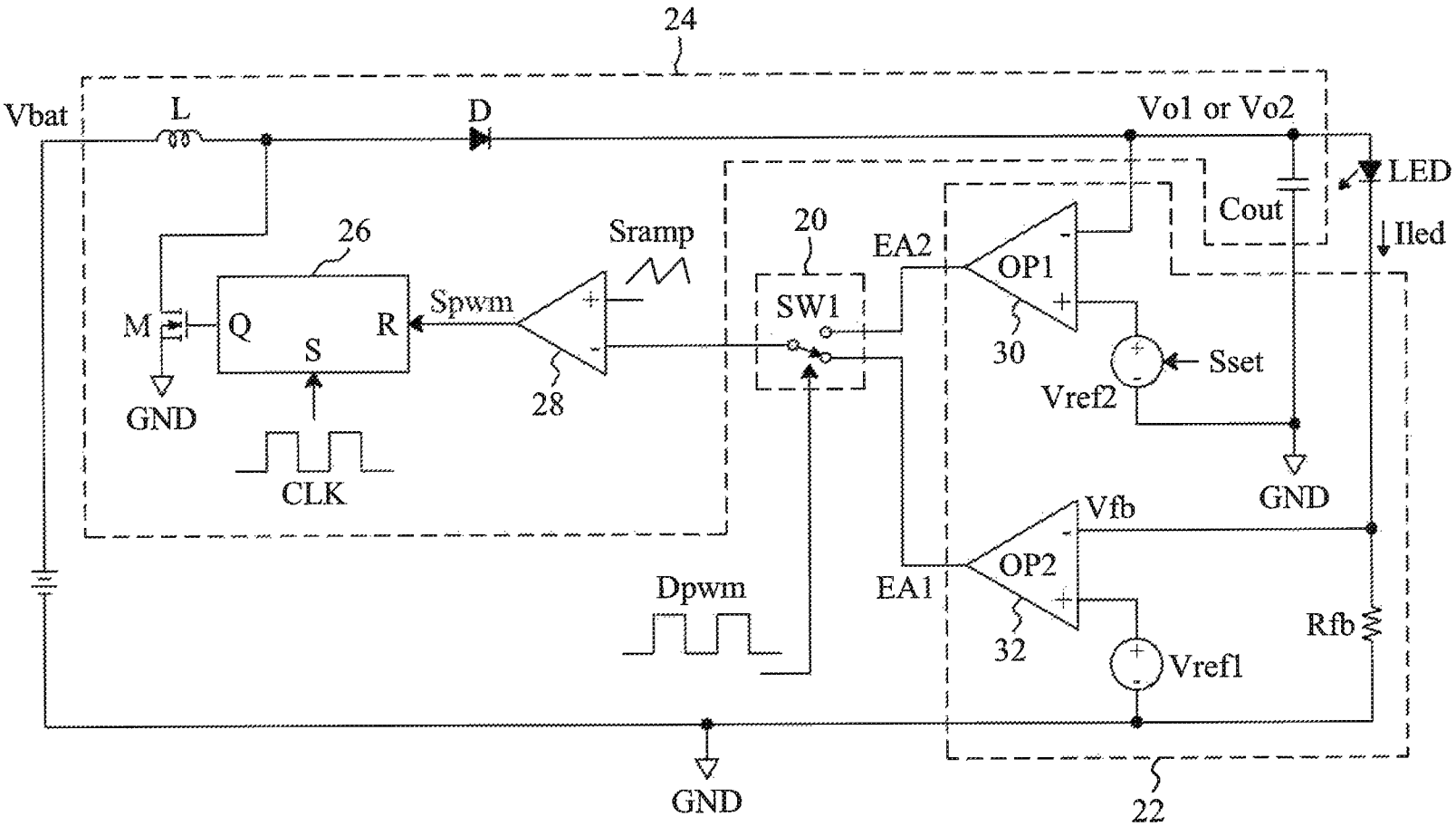
FIG. 4 is an embodiment for the selector, the voltage setting circuit and the power source shown in FIG. 3.

FIG. 4 is an embodiment for the selector 20, the voltage setting circuit 22 and the power source 24 shown in FIG. 3. In this embodiment, the power source 24 is an asynchronous boost power supply, which includes a pulse width modulation (PWM) comparator 28 to compare a ramp signal Sramp with from the output of the selector 20 to generate a PWM signal Spwm, a flip-flop 26 to switch a transistor M according to the PWM signal Spwm and a clock CLK so as to generate the driving voltage Vo1 or Vo2. The voltage setting circuit 22 includes an error amplifier 30 to amplify the difference between the driving voltage Vo1 or Vo2 and a reference voltage Vref2 so as to generate the driving voltage setting signal EA2, where the reference voltage Vref2 may be adjusted by the off voltage setting signal Sset, a current sense resistor Rfb serially connected to the LED to detect the current Iled of the LED so as to generate a feedback signal Vfb, and an error amplifier 32 to amplify the difference between the feedback signal Vfb and a reference voltage Vref1 so as to generate the driving voltage setting signal EA1. The selector 20 includes a switch SW1 controlled by the dimming signal Dpwm. When the dimming signal Dpwm is high, the switch SW1 transmits the driving voltage setting signal EA1 to the PWM comparator 28, so that the power source 24 regulates its output voltage at Vo1 such that Vfb=Vref1, and the current Iled is regulated at Vref1/Rfb. When the dimming signal Dpwm is low, the switch SW1 transmits the driving voltage setting signal EA2 to the PWM comparator 28, so that the power source 24 regulates its output voltage at the preset low voltage Vo2=Vref2.

Figure 5:
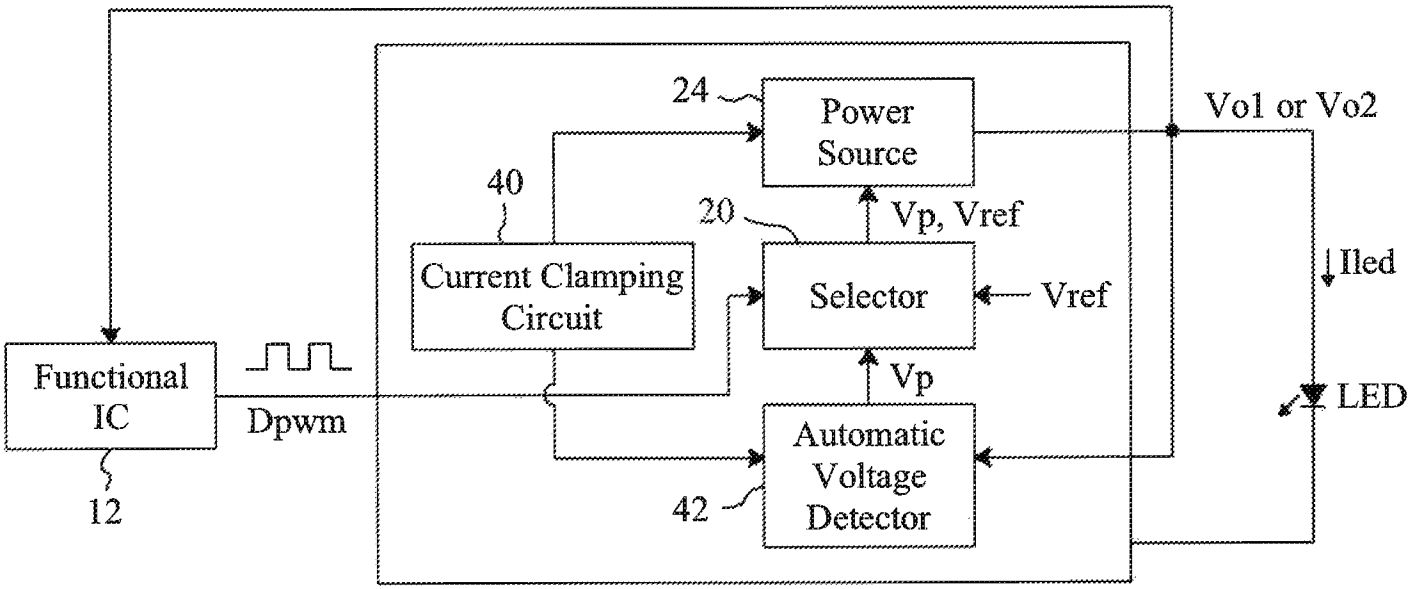
FIG. 5 is a second embodiment according to the present invention.

FIG. 5 is an embodiment of an automatic off voltage detect system according to the present invention, which has two phases, phase 1 is only lasted for a short time after the system starts, and after phase 1 is finished, the system moves to phase 2. In addition to the functional IC 12, the selector 20 and the power source 24 as that of FIG. 3, this embodiment further includes a current clamping circuit 40 and an automatic voltage detector 42. In phase 1, under control of the current clamping circuit 40, the power source 24 supplies the LED with its predefined off current, e.g. less than 100 uA, and the automatic voltage detector 42 detects and records the forward voltage of the LED to determine a driving voltage setting signal Vp. Phase 2 is normal operation, in which the power source 24 supplies the LED with its normal operation current or voltage. Upon the PWM dimming signal Dpwm, the LED dimming circuit turns on and off the LED between the pre-detected forward voltage Vo2 and its normally operation forward voltage Vo1. In phase 2, the automatic voltage detector 42 does not detect the forward voltage of the LED anymore, and the selector 20 selects one of the driving voltage setting signals Vref and Vp according to the dimming signal Dpwm, for the power source 24 to provide the driving voltage Vo1 or Vo2 for the LED and the functional IC 12. Each of the driving voltages Vo1 and Vo2 is as large as enough to drive the functional IC 12.

Figure 6:
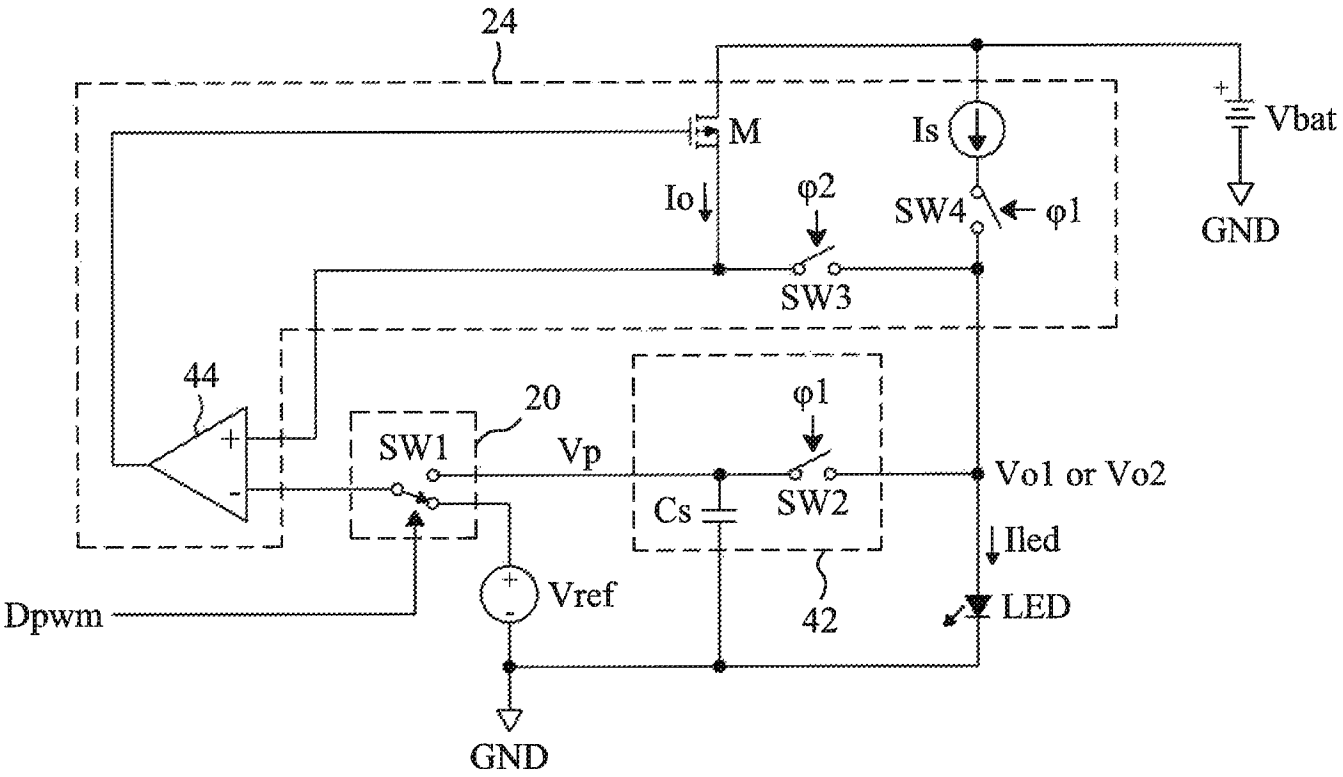
FIG. 6 is an embodiment for the selector, the voltage setting circuit and the power source shown in FIG. 5.

FIG. 6 is an embodiment for the selector 20, the power source 24 and the automatic voltage detector 42 shown in FIG. 5. In this embodiment, the power source 24 is a linear voltage regulator that includes an error amplifier 44, a transistor M, a current source Is and switches SW3 and SW4. The error amplifier 44 controls the transistor M according to the difference between its two inputs, to regulate the current to of the transistor M. The switch SW3 is connected between the transistor M and the LED, and controlled by a signal ϕ2 coming from the current clamping circuit 40. The switch SW4 is connected between the current source Is and the LED, and controlled by a signal ϕ1 coming from the current clamping circuit 40. The automatic voltage detector 42 includes a sample-and-hold circuit established by a capacitor Cs and a switch SW2. The switch SW2 is controlled by the signal ϕ1. The selector 20 includes a switch SW1 controlled by the dimming signal Dpwm to transmit either the recorded voltage Vp or the reference voltage Vref as the driving voltage setting signal to the error amplifier 44. In phase 1, the signal ϕ1 turns on the switches SW2 and SW4, and the signal ϕ2 turns off the switch SW3, so that the current source Is supplies a small current, e.g. 10 μA, to the LED, and the LED generates a voltage being recorded in the capacitor Cs as the voltage Vp. In phase 2, the signal ϕ1 turns off the switches SW2 and SW4, and the signal ϕ2 turns on the switch SW3, so that the current source Is stops supplying the small current to the LED, and the automatic voltage detector 42 stops sampling the voltage of the LED. Upon the dimming signal Dpwm, the switch SW1 is switched to transmit the driving voltage setting signal Vref or Vp to the error amplifier 44 that regulates the current Io according to the difference between the voltage of the LED and the driving voltage setting signal Vref or Vp, so that the output voltage of the power source 24 supplied to the LED is switched between the driving voltage Vo1 and Vo2.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A dimming circuit for supplying an output voltage to a LED according to a dimming signal provided by a functional IC, the dimming circuit comprising:

a selector connected to the functional IC, being controlled by the dimming signal to select one of a first driving voltage setting signal and a second driving voltage setting signal as an output of the selector;

a power source connected to the functional IC and the selector, providing a first driving voltage or a second driving voltage as the output voltage according to the output of the selector, supplying the output voltage to the functional IC, and providing a predefined current to the LED in a first one of two phases;

a voltage source connected to the selector, providing a reference voltage as the first driving voltage setting signal; and an automatic voltage detector connected to the selector and the power source, detecting and recording a voltage of the LED in the first phase as the second driving voltage setting signal.

2. The dimming circuit of claim 1, wherein the automatic voltage detector comprises:

a capacitor connected to the selector, recording and providing the second driving voltage setting signal; and a switch connected between the LED and the capacitor, being controlled to connect the LED to the capacitor in the first phase.

3. A dimming method for supplying an output voltage to a LED according to a dimming signal provided by a functional IC, the dimming method comprising the steps of:

(A) providing a first voltage setting signal and a second voltage setting signal;

(B) selecting one of the first voltage setting signal and the second voltage setting signal according to the dimming signal; and (C) providing a first driving voltage or a second driving voltage as the output voltage according to the selected driving voltage setting signal, and supplying the output voltage to the functional IC;

wherein the step A comprises the steps of:

providing a reference voltage as the first voltage setting signal; and in a first one of two phases, supplying a predefined current to the LED, and detecting and recording a voltage of the LED as the second voltage setting signal.

* * * * *